United States Patent [19]

Klann

[11] Patent Number: 4,641,554

[45] Date of Patent: Feb. 10, 1987

[54] WRENCH FOR EFFECTING SCREW CONNECTIONS OF INACCESSIBLE PARTS OF MOTOR VEHICLES

[76] Inventor: Horst Klann, Terra-Wohnpark 12, D-7730 Villingen-Schwenningen, BRD, Fed. Rep. of Germany

[21] Appl. No.: 690,164

[22] Filed: Jan. 10, 1985

[30] Foreign Application Priority Data

Jan. 13, 1984 [DE] Fed. Rep. of Germany ... 8400871[U]

[51] Int. Cl.[4] ..... B25B 13/48

[52] U.S. Cl. ..... 81/55; 81/52

[58] Field of Search ..... 81/55, 13, 56, 9.24, 81/52, 58.1

[56] References Cited

U.S. PATENT DOCUMENTS 1,208,449 12/1916 Attwasser ..... 81/55
2,375,270 5/1945 Yonkers ..... 81/55
3,277,749 10/1966 Osburn et al. ..... 81/55

FOREIGN PATENT DOCUMENTS 58836 9/1891 Fed. Rep. of Germany ..... 81/55

*Primary Examiner*—Roscoe V. Parker
*Assistant Examiner*—Maurina Rachuba
*Attorney, Agent, or Firm*—McGlew and Tuttle

[57] ABSTRACT

A wrench for inaccessible screw connections of motor vehicle linkages particularly for screwing and unscrewing the first part such as a ball pivot socket having its associated steering rod in respect to a second part such as a threaded pin of a pitman arm is employed in conjunction with an arrangement where both parts have diametrically opposite parallel wrench flats and one part has a stop surface for locating the wrench. The wrench includes a tube of a size to engage over the parts and has internal stop engageable with the predefined stop surface of the one part so as to ensure orientation of the tube relative to the two parts. The tube carries a ring shaped wrench head portion with a first diametrically extending recess into which a first wrench is engageable. The wrench has spaced apart wrench jaws which are engageable with the flats of the part having the stop surface. In addition, the tube carries an end ring part which is rotatable in respect to the remainder of the tube and has a second diametrically extending recess into which a second wrench extends which has wrench jaws engageable with the flats of the other part. The arrangement includes rods for holding one of the end ring part and the tubes while the other is rotated to effect a threading of the two parts either together or apart in accordance with the direction of rotation.

9 Claims, 13 Drawing Figures

WRENCH FOR EFFECTING SCREW CONNECTIONS OF INACCESSIBLE PARTS OF MOTOR VEHICLES

FIELD AND BACKGROUND OF THE INVENTION

This invention relates in general to the construction of wrenches and in particular to a new and useful wrench for engaging and disengaging threadable parts which are in an inaccessible location.

The invention relates to a wrench for screw connections on motor vehicle steering linkages, in particular to screw and unscrew a ball joint socket including its steering rod to or from a threaded pin of a pitman arm, both the pitman arm and the ball joint socket each being provided with at least two diametrically opposed, parallel wrench flats.

There are motor vehicles, particular passenger cars, where such steering linkages are enveloped so tightly by other body or engine parts that the wrench flats of the screw connections, i.e. of the ball joint sockets and pitman arms, cannot be turned relative to each other with normal wrenches because no free space is available for the respective wrench to be rotated. It is necessary, therefore, to provide special tools to tighten or unscrew such screw connections, which tools can be attached from the free end of the ball-mounted steering rod to the wrench flats of both the pitman arm and the ball joint socket and can be turned or held as a counterlock.

Accordingly, it is an object of the invention to create a wrench of the kind mentioned at the outset which is as easy to handle as possible and provides, in particular, the possibility of finding, in a simple manner, the wrench flats of both the ball joint socket and pitman arm to attach and fix the wrench profiles to them in self-locking fashion. In addition, the attached and fixed wrench profiles should also be readily detachable and the whole wrench easily removable again. Turning one wrench profile relative to the other from the free end of the steering rod both directions should also be feasible, simple and safe.

SUMMARY OF THE INVENTION

According to the invention, a tube which can be axially pushed over the steering rod has one end with a ring like wrench head having two movable wrench jaws for the wrence flats of the ball joint socket, said wrench head being pushable over the ball joint socket against a stop. The wrench head is provided at its face opposite the tube, with a turnable ring part having a radial slot opening in which is insertable a separate fork wrench to accommodate the wrench flats of the pitman arm.

Besides the advantages resulting from the posed problem and the improved properties, the inventive device thus characterized has the advantage that the self-centering and axially positioning wrench head is attachable to the screw connection in such a way that finding the wrench flats on the ball joint socket and on the pitman arm and placing the wrench profiles against these wrench flats is very simple.

In this connection, it may be advantageous for some applications if the fork wrench, which is applied as counterlock for the pitman arm, which is nonrotatable per se, to the latter's wrench flats, is provided with an extension rod.

For other applications where a fork wrench with an extension rod cannot be used, it is provided in a further development of the invention that the fork wrench has, at a web back interconnecting two fork legs, a socket wrench hole, into which the socket wrench profile disposed at one end of a counterlock rod can be nonrotatably inserted, the other end of the counterlock rod likewise being provided with a socket wrench profile.

With such an embodiment of the invention it is possible to actuate or effect the counterlock also from the free end of the steering rod.

According to another embodiment of the invention it is provided that there is rotatably mounted on the tube a support collar having an eccentric hole which runs parallel to the tube axis and in which the counterlock rod is guided so as to be axially movable and rotatable, but fixed axis-parallel.

This assures that the counterlock rod can be held in a position parallel to the tube axis despite the eccentric counterlock forces and that counterlocking can, for this reason, be accomplished much more easily and safely when unscrewing as well as when tightening the screw connection.

The mobility of the wrench head is needed because in such screw connections the wrench flats of the ball joint socket are usually disposed on the otherwise cylindrical ball joint socket half facing the pitman arm and are respectively located on a radius that is smaller than that which corresponds to the largest outside radius of the ball joint socket.

One embodiment of the wrench provides for the movable wrench jaws to consist of two parallel legs of a separate fork wrench introduceable into a radial wrench head guide slot to accommodate the ball joint socket wrench flats.

In this connection it is of advantage if both the wrench head guide slot and the closing opening of the ring part have diametrically opposed, parallel bearing surfaces for the fork legs of the fork wrenches.

This makes it possible to guarantee reliable, form-locking seating of the fork wrench on the wrench flats even if the fork wrench design is weak or light, and to assure that, even when the great torques become effective, as required for the tightening or loosening of the screw connection, the fork wrench legs cannot bend apart.

So that the fork wrenches can be arrested in the wrench head or in the ring part so as not to drop out when turned or otherwise handled, the wrench head and the ring part are both provided with detention or clamping devices to hold the inserted fork wrenches.

A somewhat more sophisticated, but easier to handle embodiment of the device according to the invention provides for the wrench jaws to be disposed each on dual-armed rockers which are pivoted in diametrically opposed, slotshaped recesses in a wrench socket and which rotate about eccentrically disposed transverse shafts. These rockers are radially pivotable by means of two symmetrical radial cams disposed diametrically opposite to each other, and rotatable about the tube axis relative to said transvers shafts.

The particular advantage of this embodiment is that when the wrench head turns about the stationary ball joint socket, the wrench jaws automatically make contact with the wrench flats and are kept in contact by the radial cams, as long as the wrench head is not turned back in the opposite direction. Consequently, this embodiment obviates the necessity of manually causing the fork wrench provided in the other embodiment to engage the two wrench flats of the ball joint socket.

A further development of the invention provides for the wrench head socket to be rotatably mounted on the cylindrical end section of the tube which has the two radial cams, and for the two radial cams to be provided with a radial protrusion against which the two rocker arms which are actuated by the radial cams rest, and which limit the angle of rotation of the wrench head socket relative to the tube in both rotary directions.

This makes it possible to establish, without further special manipulations, a rigid connection between the tube and the rotatable part of the wrench head, or between the tube and the wrench jaws, as soon as the wrench jaws have assumed their seat on the diametrically opposed wrench flats of the ball joint socket as required for tightening or loosening of the screw connection. All that is needed to detach the wrench jaws from two wrench flats and remove the wrench head from the ball joint socket that is screwed to the pitman arm, is to turn the tube with the two radial cams back in the opposite direction by about 90°. It being expedient in this connection for the two rockers to be loaded by a spring which pushes the wrench jaws radially outwardly and the lever arms opposing the wrench jaws of the rockers radially inwardly against the radial cams so that the opening pivoting motion of the two rockers and the radial detachment of the wrench jaws from the wrench flats is automatic and does not have to be performed manually.

Accordingly, it is an object of the invention to provide an improved wrench for inaccessible screw connections of parts such as a ball joint socket with its steering rod portion in respect to a threaded pin of a pitman arm which includes a tubular member which engages over the parts and carries wrench elements which are engageable with the respective parts in an arrangement where one of the wrench elements may be rotated relative to the other to effect the threading of the parts.

A further object of the invention is to provide a new and useful wrench which is simple in design, rugged in construction and economical to manfacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1, 2, 3, 4:
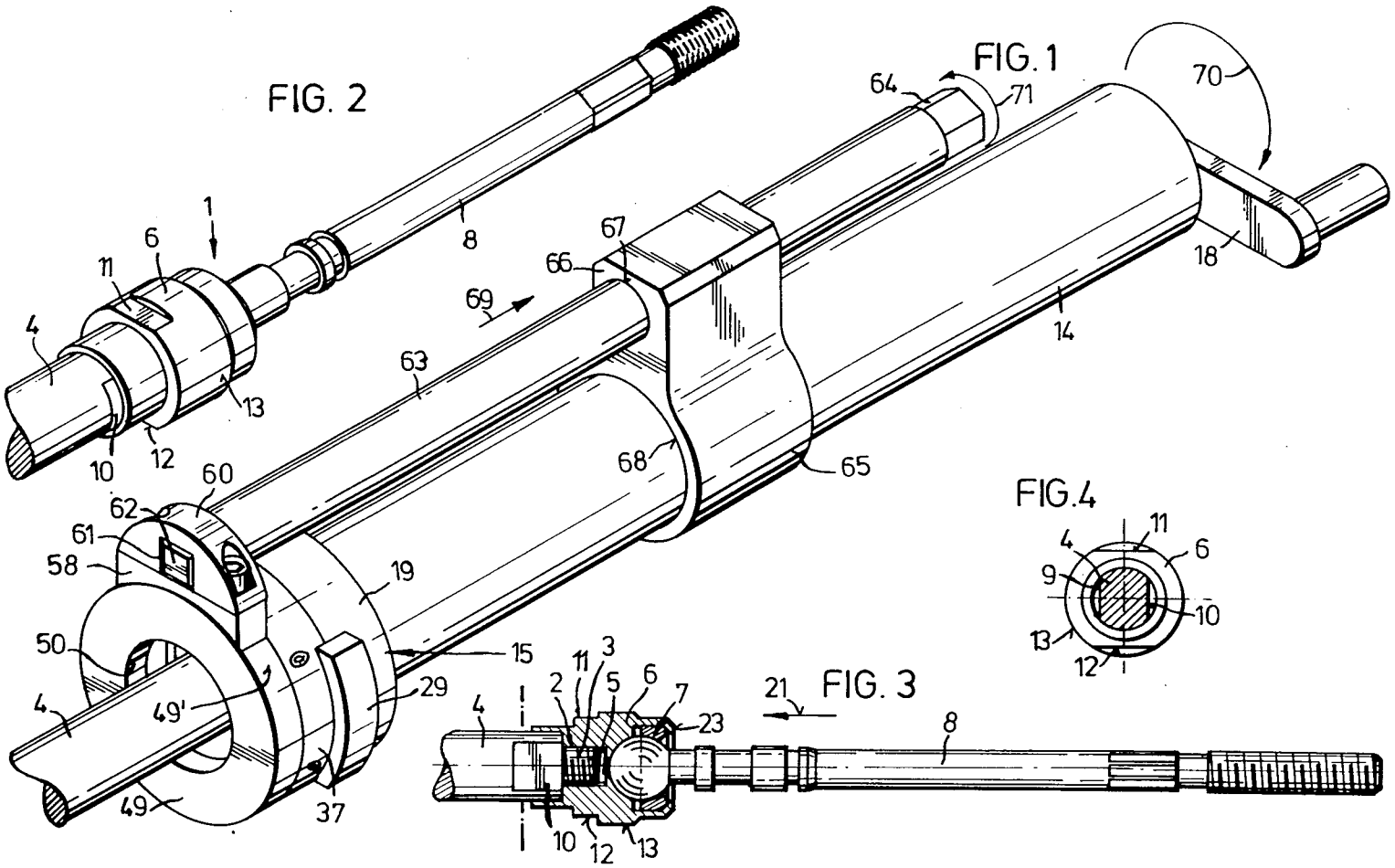
FIG. 1 shows a wrench according to the invention, complete, in perspective side view.
FIG. 2 is a perspective side view of a steering rod with ball joint socket and end section of a pitman arm.
FIG. 3 shows the same parts as in FIG. 2, in partly sectioned side view.
FIG. 4 is a section taken through the pitman arm of FIG.3.

Referring to the drawings in particular the invention embodied therein comprises a wrench for inaccessible screw connections of motor vehicle linkages particularly for screwing and unscrewing a first part such as a ball joint socket 6 having a steering rod 8, in respect to a second part such as a threaded pin 2 of a pitman arm 4 as shown in FIG. 3. Also the parts have at least two diametrically opposite wrench flats such as the flats 11 and 12 on the ball socket 6 and the flats 9 and 10 on the pitman arm 4. In addition, one of the parts such as the ball socket 6 has a surface such as a surface 23 which provides an axial motion stop controlling surface against which an interior stop element of the wrench tube 14 is engageable in order to position the tube in an arrangement in which both sets of flats may be engaged.

Figures 10, 11, 12, 13:
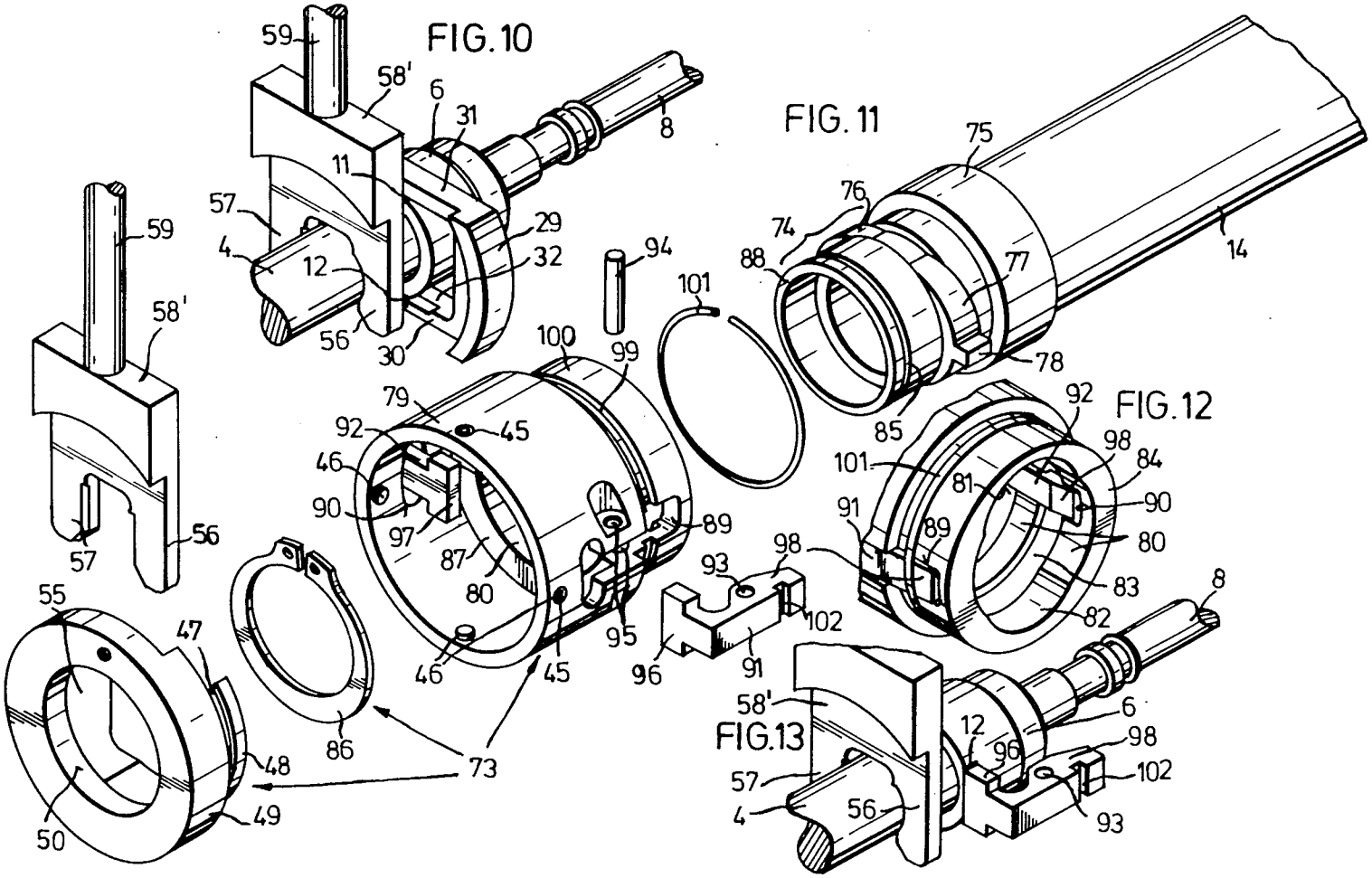
FIG. 10 shows the ball joint socket shown in FIGS. 2 and 3, screwed to the end of a pitman arm, in perspective view, with two fork wrenches of FIGS. 5 and 7, schematically applied in form-closing fashion to the wrench flats of both the ball joint socket and the pitman arm.
FIG. 11 is an extended perspective view of another embodiment of the wrench with a wrench head disassembled into its components.
FIG. 12 is a perspective rear view of the rotatable wrench head part.
FIG. 13 is a perspective view of the ball socket, screwed to the end section of a pitman arm, with a wrench jaw schematically applied to one of its two wrench flats, and with a fork jaw form-lockingly engaging the wrench flats of the pitman arm, the wrench head having been omitted from the drawing.

Shown in FIGS. 1 and 5 to 7 on the one hand, and FIGS. 11, 12 and 13 on the other are two different embodiments of the wrench according to the invention, both serving the same purpose. Both embodiments are intended to connect or disconnect, on a steering linkage 1 as shown in FIGS. 2, 3 and 10, 13, respectively, screw connection 3 between a threaded pin 2 of a pitman arm 4 and the tapped hole 5 of the ball joint socket 6 in which the steering rod 8 is mounted by means of a ball joint 7, for the purpose of making repairs while this steering linkage is installed in a motor vehicle, e.g. a passenger car, and tightly enveloped by other body or engine parts so that there is no room for the operation of normal wrenches. It is evident from FIGS. 3 and 4 that there are provided, on the end section of the pitman arm 5 on the one hand, and on the otherwise cylindrical outside large diameter 13 of the ball joint socket 6 on the others, two each diametrically opposed, wrench flats 9, 10 and 11, 12 respectively, which run parallel to each other in pairs and to which appropriate wrenches must be applied if it is intended to unscrew or tighten the screw connection 2.

It must be taken into account here that such wrenches can be applied and operated only from the free end of the steering rod 8 because of the restricted space situation, and it must be noted that the two wrench flats 11 and 12 of the ball joint socket 6 are disposed on an end section of the outside diameter 13 opposite the steering rod 8. Steering rod 8 forms an axially extending portion of the ball joint socket 6.

Referring to FIGS. 1 and 5 through 10, a first embodiment example of a wrench according to the invention will now be described.

Figures 5, 6, 7, 8, 9:
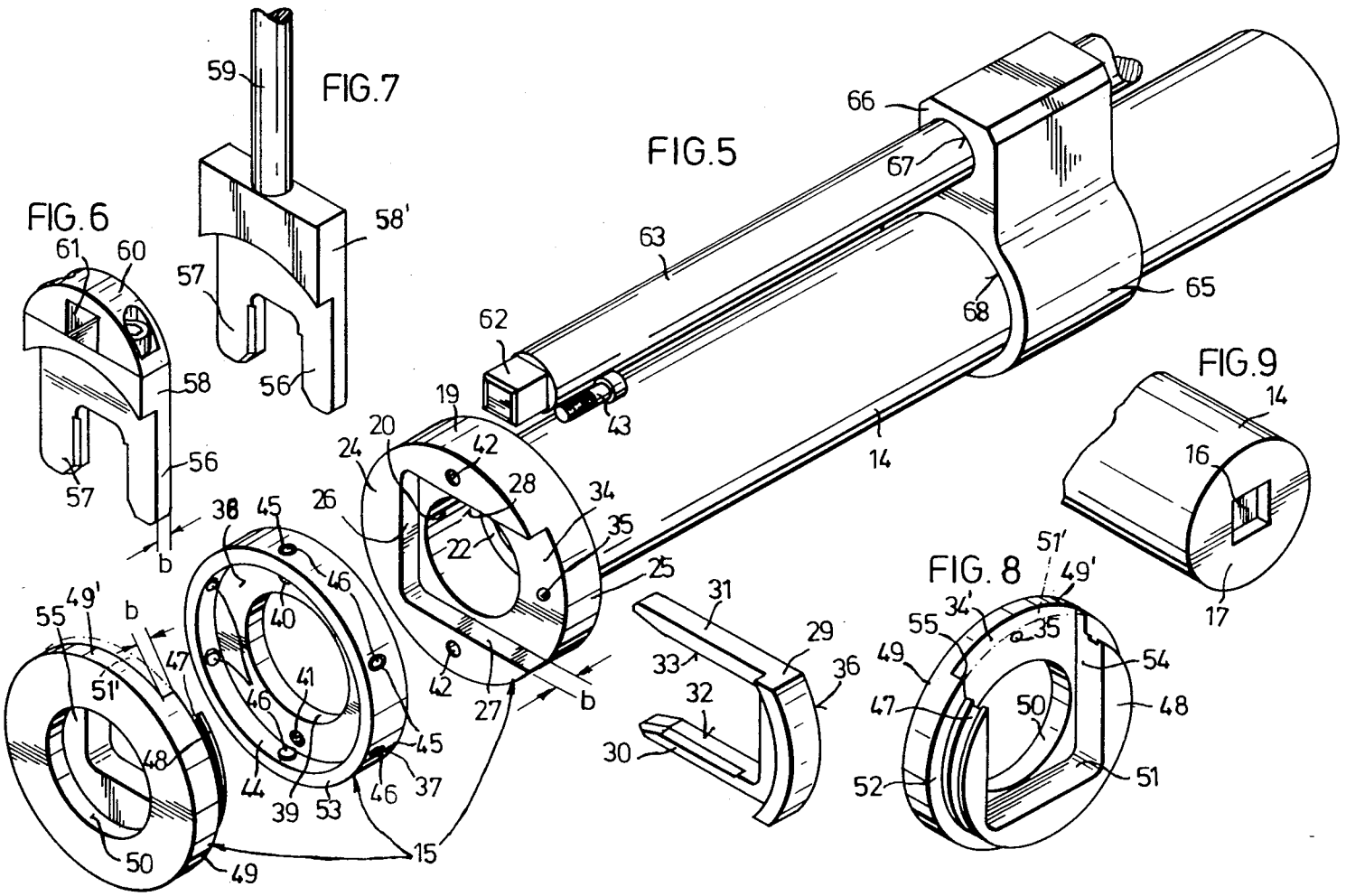
FIG. 5 shows the wrench of FIG. 1, with its screw head disassembled into its components, in perspective side view.
FIG. 6 is a perspective view of a fork wrench.
FIG. 7 is a view similar to FIG. 6 of another fork wrench.
FIG. 8 is a perspective view rear view of a ring part with slot opening.
FIG. 9 is a rear perspective view of the tube of the wrench shown in FIG. 5.

The wrench comprises a cylindrical tube 14, equipped at one end with a wrench head 15 and at the other end with a wrench profile 16 (FIG. 9). The wrench profile 16 is formed of a central, square recess in the face wall 17. A fitting, square pin of a crank 18 can be inserted in this wrench profile 16. The wrench head 15, shown in its components in FIG. 5, comprises an annular plate 19 directly and rigidly connected to the tube 14 and having a cylindrical bore 20. The diameter of the bore 20 is such that the annular plate 19 can be pushed in axial directions over the cylindrical outside diameter 13 of the ball joint socket 6 in the direction of arrow 21 (FIG. 3). Between the smaller diameter, cylindrical cavity of tube 14 and the bore 20 there is a radial shoulder 22 as stop for the annular stop surface 23 of the ball joint socket 6 which faces the free end of the steering rod 8. Machined into the face 24 of the annular plate 19 opposite the tube 14 is a recess 26 which is rougly rectangular and open on one side of the outside diameter 25 and which has two mutually parallel bearing surfaces 27 and 28 whose axial width b equals, at least approximately, the axial width of the two wrench flats 11 and 12 (FIG. 3) of the ball joint socket 6.

It is possible to insert in this recess 26 from the open side, a fork wrench 29 (FIG. 5) whose legs 30 and 31 can be applied in form-closing fashion to the bearing surfaces 27 and 28 on the one hand and their plane-parallel inside surfaces 32 and 33 to the wrench flats 11 and 12 on the other in order to produce a rigid connection between the annular plate 19 and the tube 14 and the ball joint socket 6, if the tube 14 with the ring plate 19 or with the entire wrench head yet to be described in greater detail is pushed over the steering rod 8 and the ball joint socket 6 in the direction of arrow 21 so far that the annular shoulder 22 of plate 19 rests against the annular surface 23.

So that the fork wrench 29 cannot detach from and fall out of the recess 26 itself due to its own weight, there is mounted in the recessed ring section 34 of the ring plate 19 a detent ball 35, which is spring-loaded in the axial direction, which pushes against the web wall 36 when the fork wrench 29 is introduced into the recess 26 of the ring plate 19, as shown in FIG. 1. It is mentioned here for the sake of completeness that the width of the fork legs 30 and 31 corresponds, at least approximately, to the width of the bearing surfaces 27 and 28.

To cover the face of the recess 26 a cylindrical flange ring 37 is provided which has an inner ring flange 38 with a central cylindrical bore 39 whose diameter may equal or be greater that the diameter of the bore 20 of the ring plate 19. This flange ring 37 is fastened to the ring plate 19 in coaxial arrangement by screws 43 which, penetrating through holes 42 in the ring plate 19, and are screwed in the axial direction into tapped holes 40 and 41. On its face facing away from the ring plate 19, the flange ring 37 has a cylindrical seating ring 44 which is provided with a multiplicity of radial, tapped holes 45 with set screws 46 disposed therein. The seating ring 44 serves the concentric seating of a cylindrical extension 48 of a ring part 49 which has an annular slot 47 and also a concentric, cylindrical bore 50 whose diameter should be at least as big as the diameter of the bore 39 or 20.

This ring part 49 is shown in detail in FIG. 8 in a different view than in FIG. 5. It is evident therefrom that this ring part 49 is also provided with a rectangular recess 51, open on one side of the outside diameter 49' of the ring part 49. The axial depth 51 is selected so that when the ring part 49 is joined to the flange ring 37 in the manner shown in FIG. 1, and when the ring shoulder 52 of the ring part 49 rests against the annular face 53 of the flange ring 37, there originates on the circumference an open slot opening, the width b of which may be about the same as that of the recess 26 in the ring plate 19.

The recess 51, too, has two plane parallel bearing surfaces 54 and 55 which serve to support radially the work fork legs 56 and 57 of a fork wrench 58, 58', respectively, if introduced into the just described slot opening 51' to accommodate in form closing fashion the two wrench flats 9 and 10 of the pitman arm 4.

The ring part 49 is fastened to the flange ring 37 by inserting the cylindrical extension 48 into the seating ring 44 and by radially screwing the set screws 46 into the annular slot 47 so that the ring part 49 can readily rotate without restriction relative to the flange ring 37.

If space is available in the proximity of the steering linkage installed in a motor vehicle, the fork wrench 58', equipped with an extension rod, can be used as counterlock for the pitman arm 4. In cases where this is not possible, the fork wrench 58 is provided which has, instead of the extension rod 59, a round web back attachment 60 with a square socket wrench opening 61. This socket wrench opening 61 serves to receive a first socket wrench profile 62 of a counterlock rod 63 which also is provided, at its end facing the free end of tube 14, with a second socket wrench profile 64, such as a hexagon. In any case, wrench 58 or 58' is provided rod means 63 or 59 for rotating the wrench.

Mounted on the tube 14 so as to be rotatable and, if desired, axially movable and guided with the least possible play is a support collar 65 which has, in a radial projection 66, a cylindrical hole 67 whose axis runs parallel to the tube 14 or to the axis of the cylindrical hole 68 accommodating the tube 14. The counterlocking rod 63 is guided in this hole 67 of the support collar 65, which is eccentric relative to the hole 68, so as to be axially movable and rotatable. However, as soon as its first or front wrench profile 62 sits in the profiled wrench opening 61 of the fork wrench 58, the counterlock rod 63 can no longer rotate. The ring section 34' of the ring part 49 is also provided with a spring loaded detent ball 35 whose job it is to secure the fork wrench 58 or 58', which is inserted in the slot opening 51' and recess 51, against falling out by itself.

To explain the application of the above described wrench it is assumed, to start with, that the two fork wrenches 58 (or 58') and 29 have been removed from the wrench head 15 and that the counterlock rod 63 has been retracted so far in the direction of arrow 69 that its first socket wrench profile 62 assumes approximately position near the ring plate 19 as indicated in FIG. 5. It is assumed further that the two wrench flats 9 and 10 of the pitman arm 4, since the latter cannot rotate, are located in any case in at least approximately the same angular position so that they are easy to find. Under these conditions, if the ball joint socket 6 is to be unscrewed from the pitman arm 4, the tube 14 with the wrench head 15 is then first pushed, from the free end, over the steering rod 8 and the ball joint socket 6 in the direction of arrow 21 (FIG. 3), until the annular shoulder 22 rests against the annular surface 23. Then one of the two fork wrenches 29 and 58, or 58' is first inserted into the recess 26 or slot opening 51' of the ring part 49, respectively, and the correct angular position in which the fork legs 30 and 31 or 56 and 57 can be pushed over the wrench flats 11 and 12 or 9 and 10, respectively, is found by turning either the tube 14 or the ring part 49. FIG. 10 shows schematically, with the wrench head 15 omitted, how the two fork wrenches 29 and 58' form-closingly envelops the two pairs of wrench flats 11, 12 and 9, 10, respectively. This is also the case in FIG. 1. Thus the form-closing rotary connection between the fork wrench 58 or 58' and the pitman arm 4 on the one hand and between the fork wrench 29 or the tube 14 and the ball joint socket 6 on the other is then established. Thereupon the counterlock rod 63 must be caused to engage the profiled wrench opening 61 of the fork wrench 58 in the manner shown in FIG. 1, unless the fork wrench 58' was used instead. After this is done, the screw connection 2 can be unscrewed by turning the crank 18 placed in the wrench profile 16 while at the same time exerting a countertorque in the direction of arrow 71 (FIG. 1) by means of a wrench applied to the second wrench profile 64. In this process, the entire ball joint socket 6 including the wrench is being moved in the direction of arrow 69 while the pitman arm 4 stays in place. Analogously, a ball joint socket 6 can be screwed onto the threaded pin 3 of the pitman arm 4 and tightened by turning the tube 14 in the opposite direction with the opposite counterlocking moment.

FIGS. 11, 12 and 13 illustrate a wrench with a different wrench head 73. In this embodiment there are disposed on the end section 74 facing the wrench head, spaced a certain distance from a stop ring 75, two diametrically opposed radial cams 76 and 77 whose shape is symmetrical in mirror image in relation to an imaginary center plane, each of them having in their culmination area, a radial projection 78 as which acts as a stop. Only the projection 78 of the radial cam 77 is visible in FIG. 11. The projection of the radial cam 76, not visible in the drawing, is of the same shape as the radial cam 78 and is exactly diametrically opposed thereto. The sections of tube 14 which are located on both sides of the radial cams 77 and 76 and which extend radially from the cams, are of the same diameter and have smooth, cylindrical surfaces. A freely rotatable wrench head sleeve 79 which has a fitting bore 80 is mounted on these axial sections of tube 14. So that the two radial cams 76 and 77 with their projections 78 can be introduced into the bore 80 of the wrench head sleeve 79 from the face shown in FIG. 12, this bore 80 is provided in its rear section with two diametrically opposed arched expansions 81 and 82. In addition, an annular slot 83 circling the inside is provided in the bore 80 to accommodate the radial cams 76 and 77 with their projections 78. To be able to fix the wrench head sleeve 79 on the end section 74 of tube 14 in axial direction when its annular face 84 rests against the stop ring 75, the end section 74 has an annular slot 85 in which a snap ring 86 is insertable, with which an inner ring shoulder 87 of the wrench head sleeve 79 makes contact. The annular face 88 of the end section 74 of tube 14 assumes in this embodiment the function of the ring shoulder 22 of the wrench head 15 shown in FIGS. 1 and 5 as stop surface of the annular surface 23 of the ball joint socket 6.

Provided in the wall of the wrench lead sleeve 79 are two diametrically opposed, slotlike recesses 89 and 90 which are of T shape in radial top view and are suited for the seating of the dual-armed rockers 91 and 92. These rockers 91 and 92 are of completely identical design and have bearing holes 93, by means of which they can be mounted on bearing pins 94 so as to pivot in the recesses 89 and 90. The bearing pins 94 are fastened in cross holes 95 in the wall of the wrench head sleeve 79.

Fastened to each of these rockers 91 and 92 is a wrench jaw 96 and 97, respectively, directed radially inward, while the arms 98 of the rockers 91 and 92 which oppose each other with respect to the bearing hole 93 are located in the area of the radial cams 76 and 77 when a relative rotation in the one or the other direction takes place between the tube 14 and the wrench head sleeve 79. Due to this relative rotation between the tube 14 and the wrench head sleeve 79, which can go in both rotary directions to the point where the two lever arms 98 make contact with the projections 78 of the radial cams 76 and 77, pivoting motions of the rockers 91 and 92 about the bearing pins 94 result. So that the lever arms 98 will remain in constant, positive contact with the generated surfaces of the radial cams 76 and 77, there is accommodated, in an annular slot 99 of smaller diameter, a spring ring 101 which exerts a radially inwardly directed spring force upon the two lever arms 98 of the rockers 91 and 92. Corresponding to the annular slot 99, the outer back side of the lever arms 98 are also each provided with a slot 102 to fit the spring ring 101. Cylindrical extension 100 of sleeve 79 extends on a rear side of slot 99.

The wrench head sleeve 79, too, is designed to seat a ring part 49, for which reason it has a multiplicity of radial holes 45 and radial set screws 46 which engage the slot 47. The ring part 49 also completes the wrench head shown in FIGS. 11 and 12 in the same manner as it does the wrench head of FIG. 1.

The handling and application of the wrench head shown in FIG. 11 differs from the application of the wrench with the wrench head 15 only in the following: Before the tube 14, with the wrench head sleeve 79 fastened to the end section 74 in the described manner and with the ring part 49 rotatably mounted therein, can be pushed over the steering rod 8, or before the wrench head 73 can be pushed over the ball joint socket 6, the wrench head sleeve 79 must be brought into a central position in relation to the two radial cams 76 and 77 so that the rockers 91 and 92 are approximately equispaced from the two projections, and in which position the two wrench jaws 96 and 97 are pivoted radially outward far enough so they can be pushed unhindered over the outside diameter 13 of the ball joint socket 6. When the annular face 88 of the tube 14 then is in contact with the annular face 23 of the ball joint socket 6, the two wrench jaws 96 and 97 are exactly in the plane in which the two wrench flats 11 and 12 of the ball joint socket 6 are located also, whereas the slot opening of the ring part 49, formed by its recess 51, is in the plane of the wrench flats 9 and 10 of the pitman arm. It is in this position that either the fork wrench 58 or the fork wrench 58' can now be inserted in the same manner as in the case of the wrench head 15. Either thereafter or earlier the wrench jaws 96 and 97 of the rockers 91 and 92 are applied to the wrench flats 11 and 12 of the ball joint socket 6 so that the tube 14 is turned in the rotary direction in which the ball joint socket 6 should be turned to unscrew or tighten the screw connection 2. During this rotary motion of the tube 14 the wrench head sleeve 79 with the two rockers 91, 92 is taken along until the two wrench jaws 96 and 97 have engaged the wrench flats 11 and 12 in the manner shown in FIG. 13. The wrench head sleeve 79 then stops in this angular position, and the two lever arms 98 of the two rockers 91 and 92 each rest against the projections 78 of the two radial cams 76 and 77 so that further rotation of the tube 14 in the same direction causes the ball joint socket 6 to be taken along.

Counterlocking can be accomplished in the same manner as described above in connection with the first embodiment example.

To detach the two wrench jaws 96 and 97 from the wrench flats 11 and 12 or to pivot them outwardly in radial direction, all that is required is to turn the tube 14 in the opposite direction until the wrench head sleeve 79 co-rotates also. When this is the case, the two wrench jaws 96 and 97 already sit on the cylindrical section of the ball joint sleeve 6 so that it is an easy matter to remove the tube 14 with the wrench head from the ball joint socket 6 or from the steering rod 8 again in axial direction.

While specific embodiments of the invention have been shown and described in detail to illustrate the application of the principles of the invention, it will be understood that the invention may be embodied otherwise without departing from such principles.

What is claimed is:

1. A wrench for an inaccessible screw connection of a motor vehicle, the screw connection having a first part (6) with a large diameter cylindrical portion (13) a threaded portion (3), an axially extending portion (8) connected to said large diameter portion, a radially extending stop surface (23), a pair of diametrically opposed parallel wrench flats (11,12) on an end of the large diameter portion which is opposite from the axially extending portion, the screw connection also having a second part (4) with a threaded portion (2) screwed to the threaded portion (3) of the first part (6), and a pair of diametrically opposed parallel wrench flats (9,10), said wrench comprising:

a hollow tube (14) having one end with a wrench profile (16) for use in rotating said tube, and an opposite end with a radial stop part (22,88) for engagement with the stop surface of the screw connection, said tube having a length between its ends which is at least as long as a length of the axially extending portion (8) of the screw connection so that when said stop part of said tube is engaged with the stop surface of the screw connection, said tube extends over the axially extending portion of the screw connection to bring said opposite end of said tube into the vicinity of the large diameter portion of the screw connection;

a ring-shaped wrench head (15,73) connected to said opposite end of said tube, said wrench head being fixed to said tube at least against relative axial movement between said tube and said wrench head, said wrench head having a cylindrical opening (20,80) of a diameter at least as large as the diameter of the large diameter portion (13) of the screw connection so that when said tube is moved axially over the axially extending portion of the screw connection, said cylindrical opening of said wrench head moves axially over the large diameter portion of the screw connection;

first wrench means (29,91) having opposite jaws (30,96), said first wrench means being operatively connected to said wrench head for radial movement of said opposite jaws into engagement with the wrench flat (11,12) of the first part (6) of the screw connection when the large diameter portion of the screw connection is in said cylindrical opening of said wrench head;

a ring part (49) mounted for rotation to said wrench head, axial holding means (46,47) being engaged between said wrench head and said ring part for holding said ring part at a fixed axial position on said wrench head, said ring part having an inner recess (51) which is sufficiently large for the passage of the large diameter portion (13) of the screw connection, said recess having opposite bearing surfaces (54,55) and said recess communicating with said cylindrical opening of said wrench head;

a fork wrench (58,58') having a web forming a back portion and first and second fork legs interconnected with said web to form opposite jaws, said opposite jaws having facing parallel surfaces for engagement with the pair of wrench flats (9,10) of the second part (4) of the screw connection, said fork wrench having outside bearing surfaces engageable with said bearing surfaces of said recess (51) of said ring part (59) when said fork wrench (58,58') is engaged in said recess of said ring part, said ring part having a radially extending opening therethrough extending from an exterior of said ring part into said recess thereof for receiving said fork wrench;

rod means (59,63) operatively connected to said fork wrench (58,58') for rotationally holding said fork wrench when said fork wrench is in said recess and for thereby rotationally holding said ring part, with respect to said tube so that with said opposite jaws of said first wrench means engaged with the wrench flat of the first part of the screw connection, the first part of the screw connection can be rotated with respect to the second part of the screw connection; and said opposite jaws of said first wrench means being spaced from each other when they are engaged with the wrench flats of the first part of the screw connection, by a distance smaller than the diameter of the large diameter portion of the screw connection.

2. A wrench according to claim 1, wherein said web of said fork wrench has a wrench socket opening (61) therein, said wrench socket opening extending axially parallel to said tube, said rod means comprising an axially extending counter-locking rod (63) having a first socket wrench profile (62) at one end thereof for engagement in said socket opening, and a second socket wrench profile (64) at an opposite end thereof which is in the vicinity of said wrench profile (16) of said tube.

3. A wrench according to claim 1, wherein said rod means (59) comprises a rod fixed to said web of said fork wrench and extending radially outward from said fork wrench.

4. A wrench according to claim 1, wherein said wrench head comprises an annular cylindrical plate (19) fixed to said opposite end of said tube (14), said annular plate having a rectangular axially extending recess (26) therein, said first wrench means comprising a further fork wrench (29) having a web (36) and a pair of parallel wrench legs (31,32) fixed to said web, said rectangular recess of said annular plate having parallel bearing surfaces for receiving parallel outer surface of said legs of said further fork wrench, said legs of said further fork wrench forming said opposite jaws and said further fork wrench being movable radially into said rectangular recess of said annular plate for engaging the wrench flats of the first part of the screw connection.

5. A wrench according to claim 4, wherein said web of said fork wrench has a wrench socket opening (61) therein, said wrench socket opening extendially axially parallel to said tube, said rod means comprising an axially extending counter-locking rod (63) having a first socket wrench profile (62) at one end thereof for engagement in said socket opening, and a second socket wrench profile (64) at an opposite end thereof which is in the vicinity of said wrench profile (16) of said tube.

6. A wrench according to claim 1, wherein said first wrench means comprises a wrench head sleeve rotatably mounted to said opposite end of said tube and having means for axially fixing said wrench head sleeve with respect to said tube, said opposite jaws comprising a pair of double-armed rockers pivotally mounted to said wrench head sleeve and being diametrically opposed from each other on said wrench head sleeve, said wrench head sleeve having diametrically opposed slot-shaped recesses for receiving said rockers respectively, each rocker being pivotally mounted to said wrench head sleeve about an eccentrically disposed transverse axis which is transverse with respect to the axis of said tube and which is spaced away from the axis of said tube, a pair of symmetrical radial cams disposed diametrically of each other and rotatably mounted on said tube, each rocker having a first arm for engagement with one of said radial cams and a second arm carrying a wrench head surface, said wrench head sleeve being rotatable to move said first arm of said first rockers along said radial cam for moving said wrench jaw surfaces radially together and apart for engaging and disengaging the wrench flats of the first part of the screw connection.

7. A wrench according to claim 2, including a support collar on said tube having an eccentric bore therethrough, said bore being parallel to the axis of said tube, and said counterlock rod being in said bore and being axially and rotatably movable but being fixed at a space location from the axis of said tube.

8. A wrench according to claim 6, wherein said radial cams each being provided with a radial projection, said two rockers having lever arms actuated by the radial cams which rest against said lever arms and which limit the angle of rotation of said wrench head sleeve relative to said tube in both directions.

9. A wrench according to claim 8, wherein said two rockers are influenced by a spring which pushes said wrench jaw surfaces radially outwardly and said lever arms respectively opposite to the wrench jaw surfaces of said rockers radially inwardly against said radial cams.

* * * * *